US010316777B2

(12) United States Patent
Verner et al.

(10) Patent No.: US 10,316,777 B2
(45) Date of Patent: Jun. 11, 2019

(54) METHOD FOR HEATING A SLIDING CAMSHAFT ACTUATOR

(71) Applicant: GM GLOBAL TECHNOLOGY OPERATIONS LLC, Detroit, MI (US)

(72) Inventors: Douglas R. Verner, Sterling Heights, MI (US); Scot A Douglas, Howell, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 89 days.

(21) Appl. No.: 15/483,289

(22) Filed: Apr. 10, 2017

(65) Prior Publication Data

US 2018/0291828 A1 Oct. 11, 2018

(51) Int. Cl.

| | |
|---|---|
| ***F01L 13/00*** | (2006.01) |
| ***F02D 41/06*** | (2006.01) |
| ***H05B 6/10*** | (2006.01) |
| ***F02D 41/20*** | (2006.01) |
| ***H01F 7/16*** | (2006.01) |
| ***H01F 7/18*** | (2006.01) |
| *F02D 13/02* | (2006.01) |
| *F02D 41/00* | (2006.01) |

(52) U.S. Cl.

CPC ..... *F02D 41/068* (2013.01); *F01L 13/0036* (2013.01); *F02D 41/20* (2013.01); *H01F 7/1646* (2013.01); *H01F 7/1844* (2013.01); *H05B 6/101* (2013.01); *F01L 2013/0052* (2013.01); *F01L 2013/101* (2013.01); *F01L 2800/01* (2013.01); *F01L 2800/02* (2013.01); *F01L 2820/01* (2013.01); *F01L 2820/044* (2013.01); *F02D 13/0207* (2013.01); *F02D 2041/001* (2013.01); *F02D 2041/2051* (2013.01); *F02D 2200/021* (2013.01); *F02D 2200/70* (2013.01)

(58) Field of Classification Search

CPC ..... F01L 2001/0473; F01L 1/46; F01L 2009/0484; F01L 2013/101; F01L 2013/116; F01L 2800/01; F01L 2820/031; F01L 2820/044

USPC ..... 123/90.18, 90.19

See application file for complete search history.

(56) References Cited

U.S. PATENT DOCUMENTS

| | | | | |
|---|---|---|---|---|
| 6,216,652 B1 * | 4/2001 | Gramann | F01L 9/04 | 123/90.11 |
| 2011/0303171 A1 * | 12/2011 | Oka | F01L 1/352 | 123/90.17 |
| 2013/0025568 A1 * | 1/2013 | Yokoyama | F01L 1/3442 | 123/445 |

FOREIGN PATENT DOCUMENTS

| | | | |
|---|---|---|---|
| DE | 102012021631 A1 * | 5/2014 | F01L 1/047 |

* cited by examiner

*Primary Examiner* — Jorge L Leon, Jr.

(57) ABSTRACT

A method for heating a sliding camshaft actuator at cold engine start wherein the sliding camshaft actuator includes at least one magnetic field generating coil having a core, a piston armature disposed in the core of the at least one magnetic field generating coil, a magnet in mechanical communication with the piston armature, and an actuator pin in mechanical communication with the magnet. The method includes detecting a cold engine start condition and reversing an energizing voltage on the at least one magnetic field generating coil when the outside temperature is below a predetermined temperature threshold. The reverse energizing voltage on the at least one magnetic field generating coil is maintained for a predetermined period of time to heat the piston armature, the magnet, and the actuator pin.

6 Claims, 3 Drawing Sheets

METHOD FOR HEATING A SLIDING CAMSHAFT ACTUATOR

FIELD

The present invention generally relates to sliding camshaft actuators for variable valve lift (VVL) systems, and more particularly relates to a method for heating a sliding camshaft actuator using reverse voltage.

BACKGROUND

The statements in this section merely provide background information related to the present disclosure and may or may not constitute prior art.

Internal combustion engines include intake and exhaust valves that can be actuated by cam lobes of at least one camshaft. In some configurations the camshafts are constructed with sliding camshaft assemblies having multiple steps for varying the lift distance of an engine valve. For example, a two-step sliding camshaft may include a high lift cam lobe position for lifting an engine valve to a maximum distance, and a low lift cam lobe position for lifting the engine valve below the maximum lift distance.

At least one sliding camshaft actuator is fixed on an internal combustion engine for changing position between the multiple cam lobes. Particularly, at least one actuator pin of a camshaft actuator is operative to selectively engage displacement grooves configured on the periphery of camshaft barrels formed on the sliding camshaft assembly. As the camshaft assembly rotates, an actuator pin is selected to move into a displacement groove of the camshaft barrel which causes the sliding camshaft assembly to shift into a different position along the camshaft axis. When a sliding camshaft shifts position, the intake and/or exhaust valves are actuated differently in accordance with the changed cam lobe position, e.g., a sliding camshaft may move from a high lift cam lobe position to a low lift cam lobe position, which in turn will cause the engine operation to be different.

Thus, the sliding camshaft actuator is an important component in the proper operation of a VVL sliding camshaft system. When the actuator is cool, the pins can move more slowly than the time to move the pin into the shifting groove. When this actuator is cold, and we command the actuator on longer to move the pin because it moves slower, the coil will start to warm up and the copper loses will cause the resistance to increase and the force to push the pin out will be less. This increased electrical resistance may result in sluggish engine performance until the actuator coils warm up which, for some, could be enough of an annoyance to prompt them to seek service and/or result in unfavorable product performance ratings. Thus, there is a need for a means of eliminating the negative performance characteristics of sliding camshaft actuators after ignition in cold environments.

SUMMARY

One or more exemplary embodiments address the above issue by providing a method for heating a sliding camshaft actuator using reverse voltage. More particularly, exemplary embodiments relate to a method for a sliding camshaft actuator using reverse voltage wherein the sliding camshaft actuator includes at least one magnetic field generating coil having a core, a piston armature disposed in the core of the at least one magnetic field generating coil, a magnet in mechanical communication with the piston armature, and an actuator pin in mechanical communication with the magnet.

The method includes detecting a cold engine start condition. Another aspect includes reversing an energizing voltage on the at least one magnetic field generating coil. And yet another aspect includes retracting the piston armature, the magnet and the actuator pin toward the at least one magnetic field generating coil. And still another aspect includes maintaining the reverse energizing voltage on the at least one magnetic field generating coil for a predetermined period of time to heat the piston armature, the magnet, and the actuator pin.

According to another aspect of an exemplary embodiment wherein detecting further includes reading an outside temperature sensor upon engine ignition. And another aspect of the exemplary embodiment includes energizing voltage when the outside temperature is less than or equal to a predetermined temperature threshold.

Yet another aspect of the exemplary embodiment wherein reading and reversing is performed by a control module. Still another aspect as according to the exemplary embodiment includes creating a magnetic force attraction between the magnet and the at least one magnetic field generating coil. And still another aspect in accordance with the exemplary embodiment includes dissipating heat from the at least one magnetic field generating coil to the actuator pin.

BRIEF DESCRIPTION OF THE DRAWINGS

The present exemplary embodiments will be better understood from the description as set forth hereinafter, with reference to the accompanying drawings, in which.

DETAILED DESCRIPTION OF THE INVENTION

Figure 1:
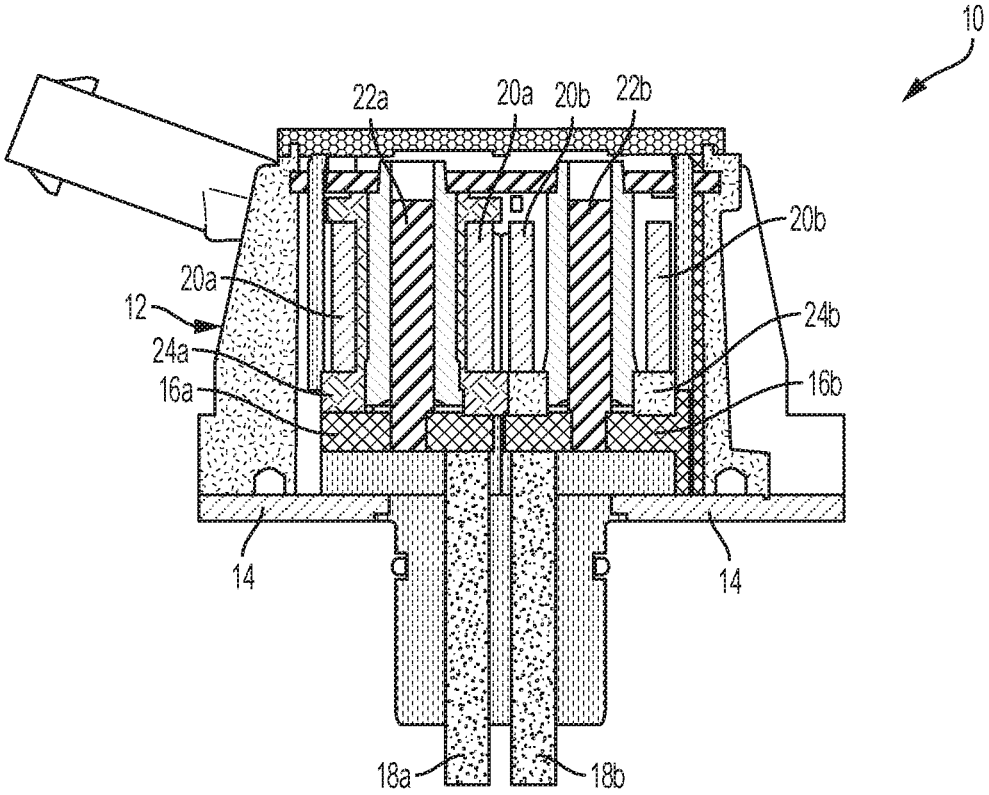
FIG. 1 is an illustration of a cross-sectional view of a sliding camshaft actuator in accordance with aspects of the exemplary embodiment.

The following description is merely exemplary in nature and is not intended to limit the present disclosure, application, or uses thereof. FIG. 1 provides an illustration of a cross-sectional view of a sliding camshaft actuator 10 in accordance with aspects of the exemplary embodiment. The sliding camshaft actuator 10 includes a housing 12 having a pin stop plate 14 disposed at its base for limiting the distance an actuator pin (18*a*, 18*b*) can travel when in an extended position. The sliding camshaft actuator includes magnets (16*a*, 16*b*) attached to actuator pins (18*a*, 18*b*), respectively, that are disposed intermediate between magnetic field generating coils (20*a*, 20*b*) and the pin stop plate 14. The magnets (16*a*, 16*b*) are also mechanically attached to piston armatures (22*a*, 22*b*) operative to be repelled and retracted along the axial core of the magnetic field generating coils (20*a*, 20*b*) when the coils are energized in accordance with aspects of the exemplary embodiments. The magnetic field generating coils (20*a*, 20*b*) are wound on spools (24*a*, 24*b*), respectively, formed of ferrous or ferrous composite material that is susceptible to foster magnetic properties in the proximity of magnetic fields.

Figure 2:
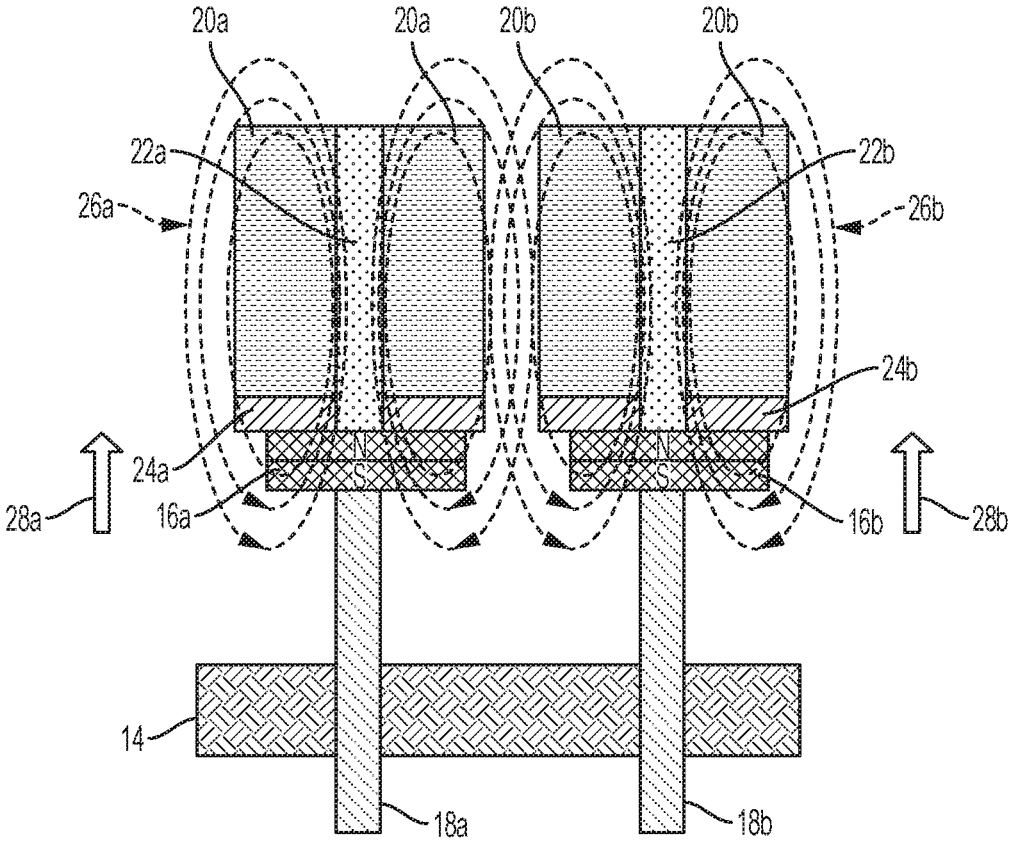
FIG. 2 is a functional illustration of a sliding camshaft actuator having a reverse voltage being applied to the magnetic field generating coil in accordance with aspects of an exemplary embodiment.

FIG. 2 is a functional illustration of a sliding camshaft actuator 10 with a reverse voltage being applied to the magnetic field generating coils (20*a*, 20*b*) in accordance with aspects of an exemplary embodiment. In a cold start condition, particularly in cold environments, the sliding camshaft actuator 10 may exhibit a degradation in performance due to an increase in friction of the pins and any friction of the magnets sliding in their sleeves. At vehicle ignition, a temperature sensor (not shown) is used to detect the outside temperature and the value is read by a control module (not shown), e.g. engine control module. If the outside temperature is determined to be less than or equal to a predetermined temperature threshold value, e.g. 23° C., then the method for heating a sliding camshaft actuator according to the exemplary embodiment is initiated.

A reverse voltage from the control module is applied to the magnetic field generating coils (20*a*, 20*b*) and magnetic flux lines (26*a*, 26*b*) create a magnetic force attraction (28*a*, 28*b*) between magnets (16*a*, 16*b*) and the magnetic field generating coils (20*a*, 20*b*), respectively. The application of the reverse voltage is maintained on the magnetic field generating coils (20*a*, 20*b*) for a predetermined period of time, e.g. 0.500 seconds, to create and dissipate heat to the piston armatures (22*a*, 22*b*), the magnets (16*a*, 16*b*), and the actuator pins (18*a*, 18*b*) such that the performance of the actuator 10 will not be inhibited by increased electrical resistance due to the coil being held to a colder temperature because the heat is being transferred into the pins.

Figure 3:
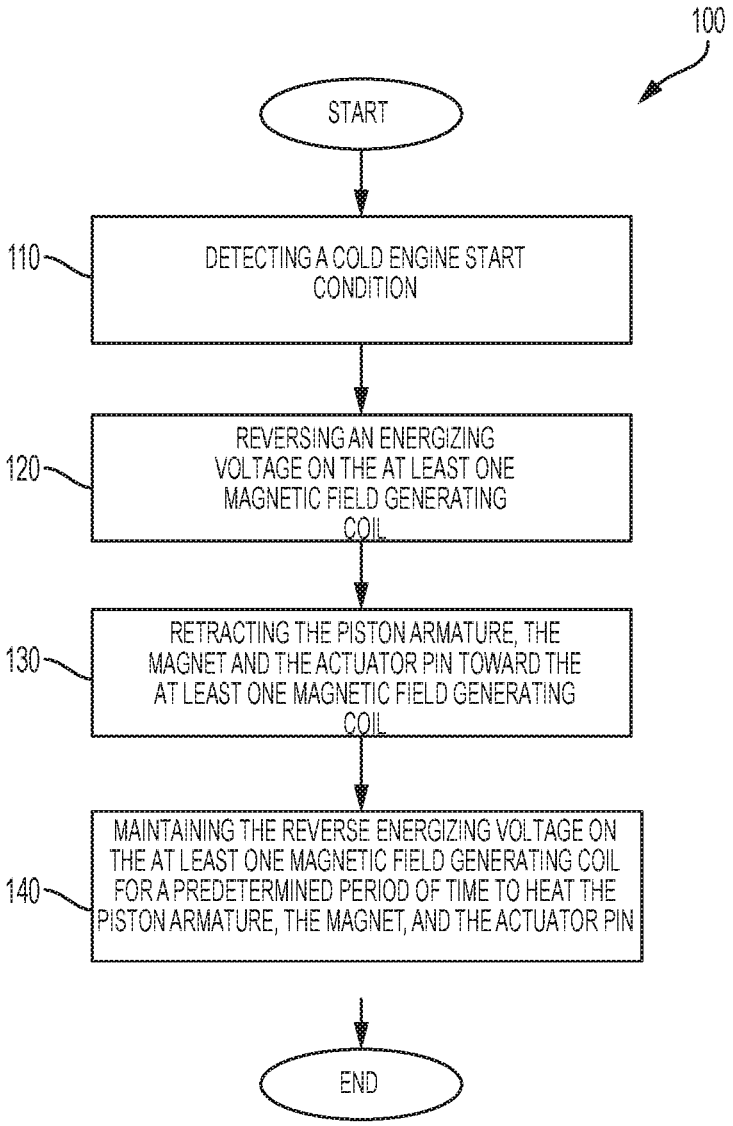
FIG. 3 is an illustration of an algorithm of the method of heating a sliding camshaft actuator using a reverse energizing voltage on the magnetic field generating coil in accordance with an exemplary embodiment.

With reference to FIG. 3, an illustration of an algorithm 100 of the method of heating a sliding camshaft actuator 10 using a reverse energizing voltage on the at least one magnetic field generating coil in accordance with an exemplary embodiment is provided. At block 110, the method begins with detecting a cold start condition upon engine ignition. As stated above, this is accomplished by an engine control module in combination with an outside temperature sensor.

At block 120, the method continues with reversing the energizing voltage on the at least one magnetic field generating coil if it is determined that the outside temperature is less than or equal to a predetermined threshold value which would be considered to be indicative of a condition where the sliding camshaft actuator may have an increased friction of the pins and any friction of the magnets sliding in their sleeves.

At block 130, the method continues with retracting the piston armature, the magnet and the actuator pin toward the at least one magnetic field generating coil. The reverse voltage applied to the at least one magnetic field generating coil creates a magnetic force attraction to accomplish the retraction as according to the exemplary embodiment.

And at block 140, the method continues with maintaining the reverse energizing voltage on the at least one magnetic field generating coil for a predetermined period of time to heat the piston armatures, the magnets, and the actuator pins. It is appreciated that the application of reverse voltage to the at least one magnetic field generating coils creates heat which is dissipated to the piston armature, the magnets, and the actuator pins such that any negative performance characteristics due to increased electrical resistance are eliminated.

The description of the invention is merely exemplary in nature and variations that do not depart from the gist of the invention are intended to be within the scope of the invention. Such variations are not to be regarded as a departure from the spirit and scope of the invention.

What is claimed is:

1. A method for heating a sliding camshaft actuator at cold engine start wherein the sliding camshaft actuator includes at least one magnetic field generating coil having a core, a piston armature disposed in the core of the at least one magnetic field generating coil, a pin stop plate, a magnet in mechanical communication with the piston armature wherein the piston armature is operative to be repelled and retracted along the axial core of the at least one magnetic field generating coil when the at least one magnetic field generating coil is energized, and an actuator pin in mechanical communication with the magnet wherein the magnet is disposed intermediate between the at least one magnetic field generating coil and the pin stop plate, the method comprising:

detecting a cold engine start condition;

reversing an energizing voltage on the at least one magnetic field generating coil;

retracting the piston armature, the magnet and the actuator pin toward the at least one magnetic field generating coil when the at least one magnetic field generating coil is energized; and maintaining the reverse energizing voltage on the at least one magnetic field generating coil for a predetermined period of time to heat the piston armature, the magnet, and the actuator pin.

2. The method of claim 1 wherein detecting further comprises reading an outside temperature sensor upon engine ignition.

3. The method of claim 2 wherein reversing further comprises energizing voltage when an outside temperature is less than or equal to a predetermined temperature threshold.

4. The method of claim 3 wherein reading and reversing is performed by a control module.

5. The method of claim 1 wherein reversing comprises creating a magnetic force attraction between the magnet and the at least one magnetic field generating coil.

6. The method of claim 5 further comprising dissipating heat from the at least one magnetic field generating coil to the actuator pin.

* * * * *